US012446684B2

(12) United States Patent
Thompson

(10) Patent No.: US 12,446,684 B2
(45) Date of Patent: Oct. 21, 2025

(54) PORTABLE TABLE TOP DISPLAY

(71) Applicant: Calibe Thompson, Fort Lauderdale, FL (US)

(72) Inventor: Calibe Thompson, Fort Lauderdale, FL (US)

( * ) Notice: Subject to any disclaimer, the term of this patent is extended or adjusted under 35 U.S.C. 154(b) by 99 days.

(21) Appl. No.: 18/379,026

(22) Filed: Oct. 11, 2023

(65) Prior Publication Data

US 2024/0122337 A1 Apr. 18, 2024

Related U.S. Application Data

(60) Provisional application No. 63/379,200, filed on Oct. 12, 2022.

(51) Int. Cl.
*A47B 3/12* (2006.01)
*A47B 3/02* (2006.01)

(52) U.S. Cl.
CPC . *A47B 3/12* (2013.01); *A47B 3/02* (2013.01)

(58) Field of Classification Search
CPC .. A47B 3/12; A47B 3/02; A47B 19/08; A47B 19/00; A47B 19/002; A47B 23/043; A47B 23/044; F16M 2200/061
USPC .... 248/441.1, 443, 444, 447, 448, 449, 452, 248/453, 454, 455, 457, 458, 459, 460, 248/461, 462, 463, 464, 465, 121, 122.1, 248/124.1, 125.1, 125.7, 125.9, 127, 130, 248/133, 134, 135, 136, 139, 140, 142, 248/144, 149, 150, 371; 40/124.01, 40/124.08, 124.09, 700, 712, 729, 745, 40/747, 748, 750, 754, 755, 756, 779, 40/780, 786
See application file for complete search history.

(56) References Cited

U.S. PATENT DOCUMENTS

| | | | | |
|---|---|---|---|---|
| 5,002,293 | A * | 3/1991 | Gottselig | B62B 3/02 280/47.35 |
| 5,109,951 | A * | 5/1992 | Lecorre | B66F 11/044 182/69.5 |
| 5,393,029 | A * | 2/1995 | Senko | A47B 23/043 248/452 |
| 6,431,319 | B1 * | 8/2002 | Myers | B62B 3/02 187/244 |
| 8,172,255 | B1 * | 5/2012 | Martin | B62B 3/04 187/244 |
| 2017/0196351 | A1 * | 7/2017 | Failing | A47B 21/02 |

* cited by examiner

*Primary Examiner* — Alfred J Wujciak
(74) *Attorney, Agent, or Firm* — Allen F. Bennett; Bennett Intellectual Property

(57) ABSTRACT

A portable table top display has two or more panels that may be collapsed to lie flush against each other for easy portability. An articulated frame allows the panels to be transformed into an extended position by separating and reorienting the panels relative to each other. Shelves on the panels allow display items to be arranged for viewing. In the collapsed configuration, apertures in the panels form a handle. The shelves may fold out of the panels, or may optionally be inserted into slots in the panels.

4 Claims, 13 Drawing Sheets

PORTABLE TABLE TOP DISPLAY

BACKGROUND OF THE INVENTION

Field of the Invention

The present invention relates to a portable table top display. More particularly, the invention relates to a specifically designed table top display system for lightweight artwork that is portable, easily assembled and disassembled, lightweight, sturdy, and adjustable. The invention is particularly useful at weekend art fairs to allow artists to efficiently setup and display multiple pieces of artwork, without their work overlapping.

Description of the Related Art

Several devices exist in the prior art which are designed to display lightweight artwork, pictures, and exhibits. These devices are limited in that they are not collapsible and easily portable, and they occupy a large amount of space, even while disassembled. Furthermore, these systems do not have adjustable shelf height placements, causing the art canvasses to overlap with each other when displayed. This will pose a problem at a weekend art fair because artists may be traveling with multiple pieces of lightweight artwork, along with the display. If the display was heavy and bulky, the artist might have to take multiple trips to set up and to disassemble their display. However, if the display was light and thin enough to fit inside a backpack or bag, the artist could easily transport the artwork and the display without laborious work.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a portable table top display that is portable, lightweight, and collapsible.

BRIEF SUMMARY OF THE INVENTION

Disclosed is a portable table top display comprising an articulated frame formed by two opposing vertical members, a rear panel extending between the two opposing vertical members, a retractable kickstand extendable from the back side of the frame, and a front panel congruent with the rear panel.

In one embodiment, the front panel has two opposing peripheral sides, two opposing scissor legs, each connecting one of the peripheral sides of the front panel to one of the opposing vertical members of the frame, and a handle extending from an upper side of the rear panel and housing a locking mechanism.

In another embodiment, the front and back panels have at least one recess housing a shelf within the opening, wherein when the shelf is in the folded position, the bottom of the shelf is flush with the front side of the front panel.

In another embodiment, the top edge of the front panel houses an art lock with a friction lock to hold the lightweight artwork in place on the shelf.

It is therefore an object of the present invention to provide a portable table top display comprising at least one panel, an articulated frame, and a retractable kickstand.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
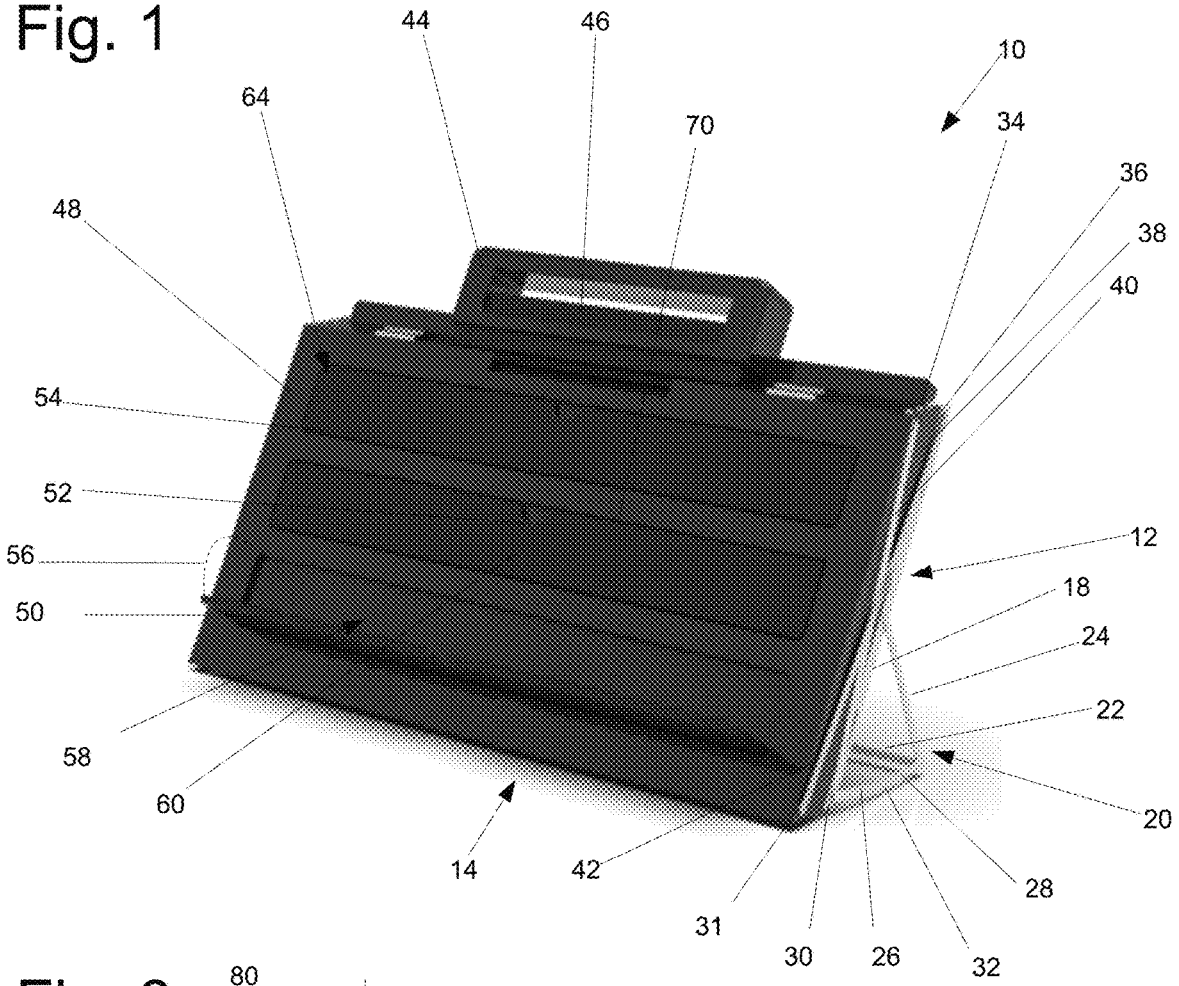
FIG. 1 is a perspective view of a portable table top display in the extended configuration in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein. Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

Unless otherwise indicated, all numbers expressing quantities of ingredients, dimensions, reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

For ease of understanding, the following definitions will apply throughout this description. However, no definition should be regarded as superceding any art-accepted understanding of the listed terms.

Various embodiments of the disclosure could also include permutations of the various elements recited in the claims as if each dependent claim was a multiple dependent claim incorporating the limitations of each of the preceding dependent claims as well as the independent claims. That is, the combinations of the various components of the invention are not limited to those combinations expressly shown in the Figures. Unless expressly stated otherwise, components described in one embodiment may be interchanged with components of the same name found in other embodiments. Such permutations are expressly within the scope of this disclosure.

Disclosed is a portable table top display comprising an articulated frame formed by two opposing vertical members, a rear panel extending between the two opposing vertical members, a retractable kickstand extendable from the back side of the frame. The front panel is congruent with the rear panel and has two opposing peripheral sides, two opposing scissor legs, each connecting one of the peripheral sides of the front panel to one of the opposing vertical members of the frame. The rear panel also has a handle extending from the upper side of the rear panel and houses a locking mechanism.

Figure 2:
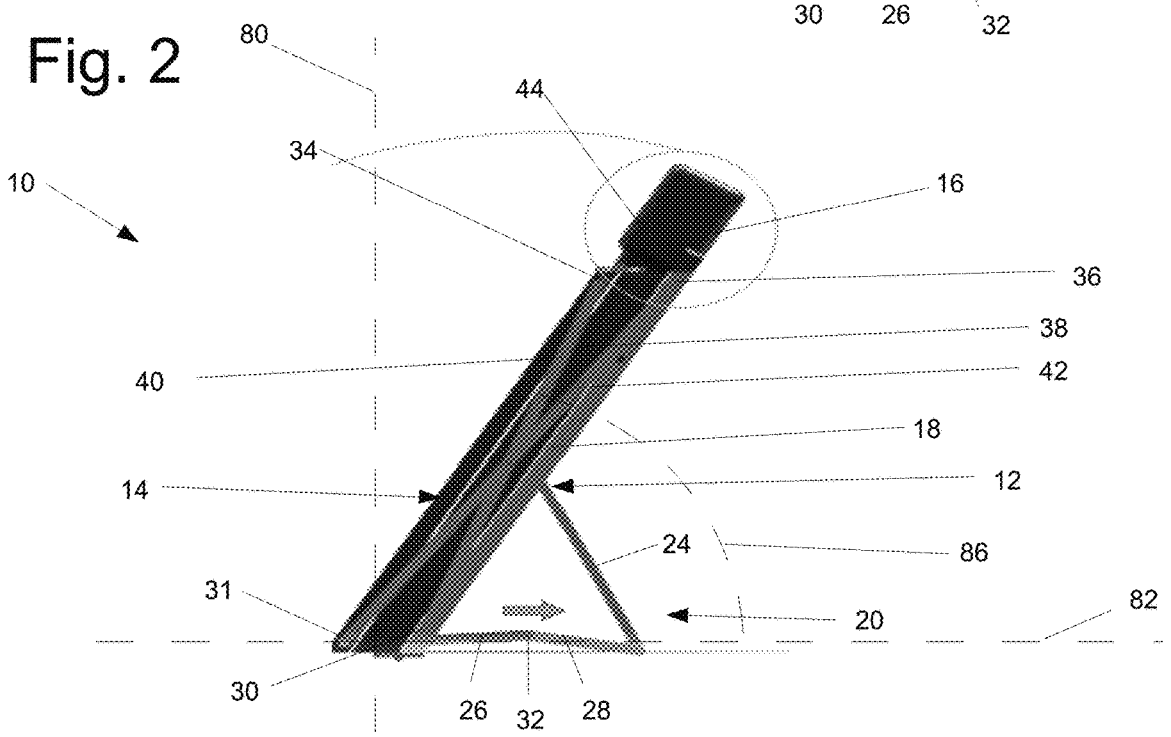
FIG. 2 is a side view of a portable table top display in the extended configuration in accordance with the principles of the invention.

FIGS. 1 and 2 display perspective and side views of an embodiment of a portable table top display 10, in accordance with the principles of the invention. The portable table top display 10 has two articulated frames 12, one on each side of the display 10, each composed of a vertical member 18 connected to two scissor legs 40 and 42. Each vertical member 18 runs along one of the two lateral sides of the rear panel 16. A retractable kickstand 20 has a horizontal base 22 coextensive with the width of the rear panel 16. Two braces 24 connect the lateral ends of the horizontal base 22 to the vertical members 18. A folding arm, formed by a proximal arm 26 and a distal arm 28 pivotally connected to each other by a hinge 32, are attached to each lateral end of the horizontal base 22, and connects it to the bottoms 30 of the vertical members 18. The two distal arms 28 connect to each end of the horizontal base 22. As shown in this embodiment, when the kickstand 20 is in the extended configuration, the first arms 26 and second arms 28 extend away from each other. When the kickstand is retracted, the first and second folding arms 26 and 28 fold substantially over each other.

As shown herein, the portable table top display 10 the rear panel 16 and front panel 14 are congruent. The front panel 14 has two lateral sides, each connected to a scissor leg 40 at the top and a scissor leg 42 at the bottom. The scissor legs 40 and 42 connect the front panel 14 to the vertical members 18 of the articulated frame 12. The first scissor leg 40 extends from the upper lateral side 34 of the front panel 14 to the bottom 30 of the vertical member 18. The second scissor leg 42 extends diagonally from the lower lateral side 31 of the front panel 14 to the top 36 of the rear panel 16 attaching to the vertical member 18. Optionally, the scissor legs 40 and 42 may be attached directly to the rear panel 16. Those having ordinary skill in the art will appreciate that the portable table top display 10 may have a single front panel, or two or more additional panels also connected by scissor legs. Optionally, the vertical members 18 can be removed and the scissor leg and kickstand components can be attached directly to the rear panel 16.

The display 10 also has a handle 44 extending from the top of the rear panel 16 which houses a locking mechanism 46. In this embodiment, with the kickstand 20 extended, the display rests at an inclination of about 60°. Those having ordinary skill in the art will appreciate that the angle of inclination may optionally be greater or less than 60°.

The front side 48 of the front panel 14 may contain at least one recess 58. Each recess 58 contains a rotatably extendable shelf 50 complementary to the recess 58 such that the bottom of the shelf 60 is flush with the front side of the front panel 48 when in the folded, retracted configuration 64. In this embodiment, the front side 48 of the front panel 14 contains three shelves 50. However, those having ordinary skill in the art will appreciate that each of the panels may include only a single shelf, or a plurality of shelves. In this embodiment, the front panel 14 includes three shelves. Each shelf contains a hinge on a bottom edge 54 and a finger slot 52 on the top edge 70. The finger slot 52 may be used to rotatably translate the shelf 50 from the folded position 64 to the open, extended position. In this embodiment, a shelf's angle of translation 56 is 90°. However, the shelf may optionally translate more or less than ninety degrees.

Figure 3:
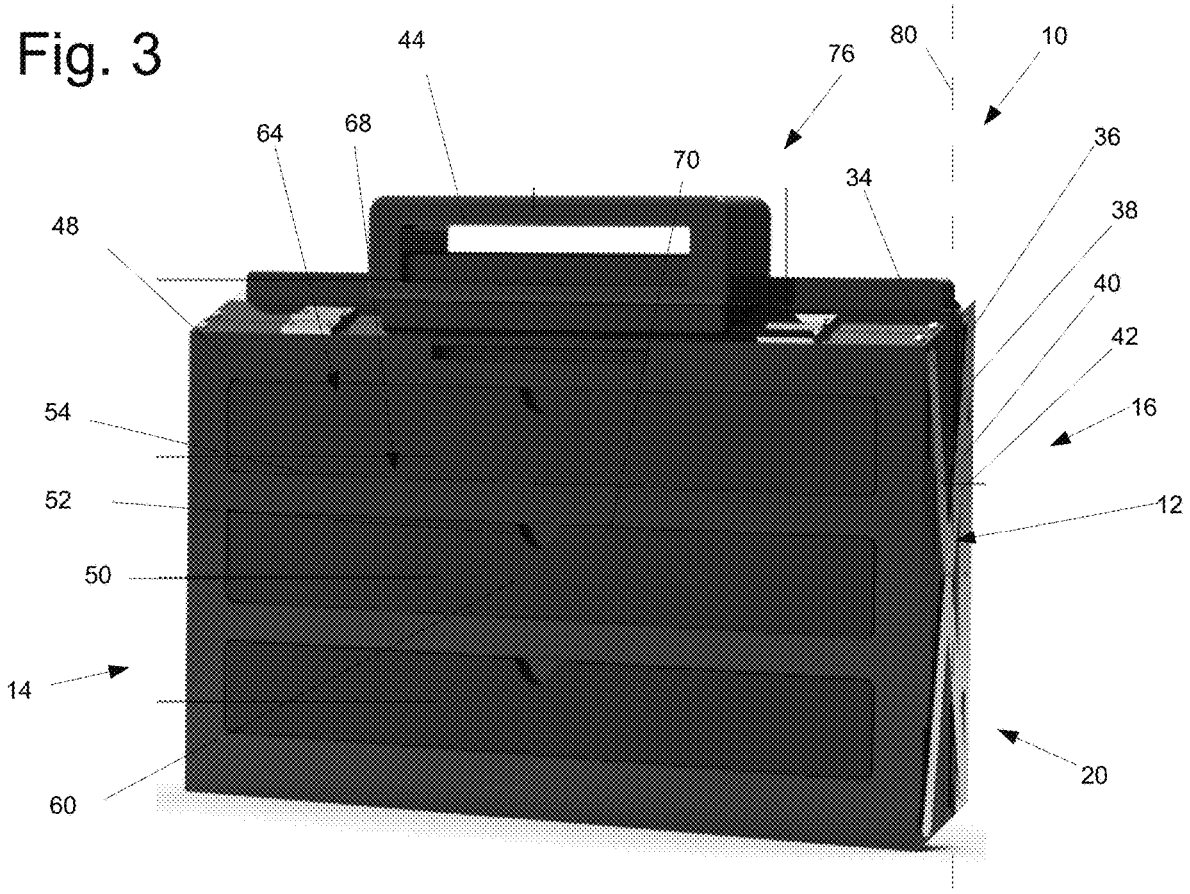
FIG. 3 is a perspective view of a portable table top display in the collapsed configuration in accordance with the principles of the invention.
Figure 4:
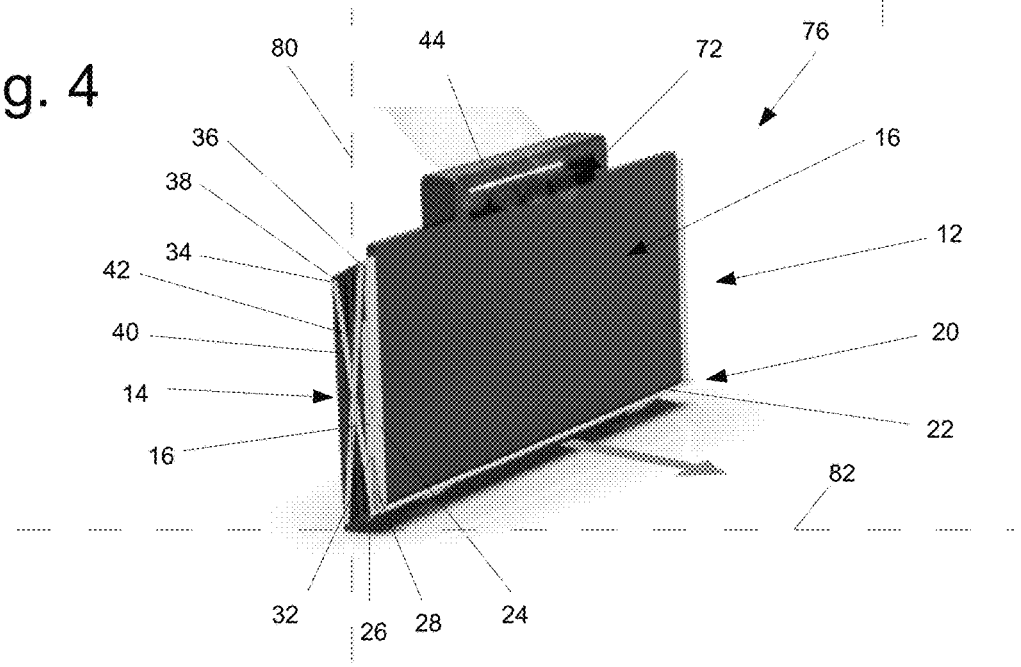
FIG. 4 is a back perspective view of a portable table top display translating from the collapsed configuration to the extended configuration in accordance with the principles of the invention.

FIGS. 3 and 4 show the portable table top display 10 in the collapsed configuration 76. In the collapsed configuration 76, the locking mechanism inside the handle 44 is engaged and holds the portable table top display 10 locked. Additionally, in this configuration, the retractable kickstand 20 is folded, the front and rear panels are in a flush against each other, and the first scissor leg 40 and the second scissor leg 42 overlap substantially more in the collapsed configuration.

To translate the portable table top display 10, the finger pull 72 on the back of the locking mechanism 46 is pulled up to release the retractable kickstand 20. When the locking mechanism is released, the first arm 26 and second arm 28 of the retractable kickstand 20 translate from a parallel to a consecutive, unfolded orientation. Additionally, the front and rear panels 14 and 16 are pulled apart and translate from a substantially vertical position, parallel to vertical axis 80, in the collapsed configuration 76 to a tilted orientation, with an angle of inclination 86 of sixty degrees, in the extended configuration.

Figure 5:
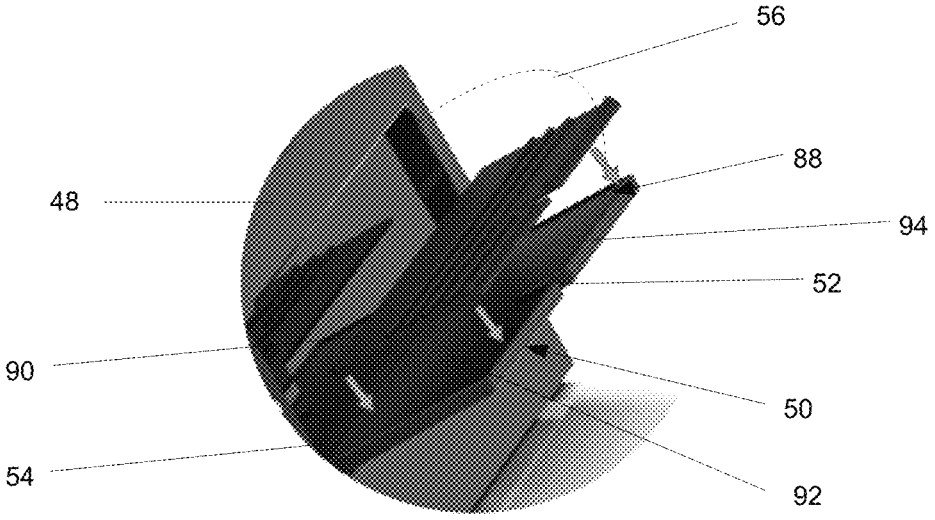
FIG. 5 is an enlarged perspective view of a shelf of a portable table top display in accordance with the principles of the invention.
Figure 6:
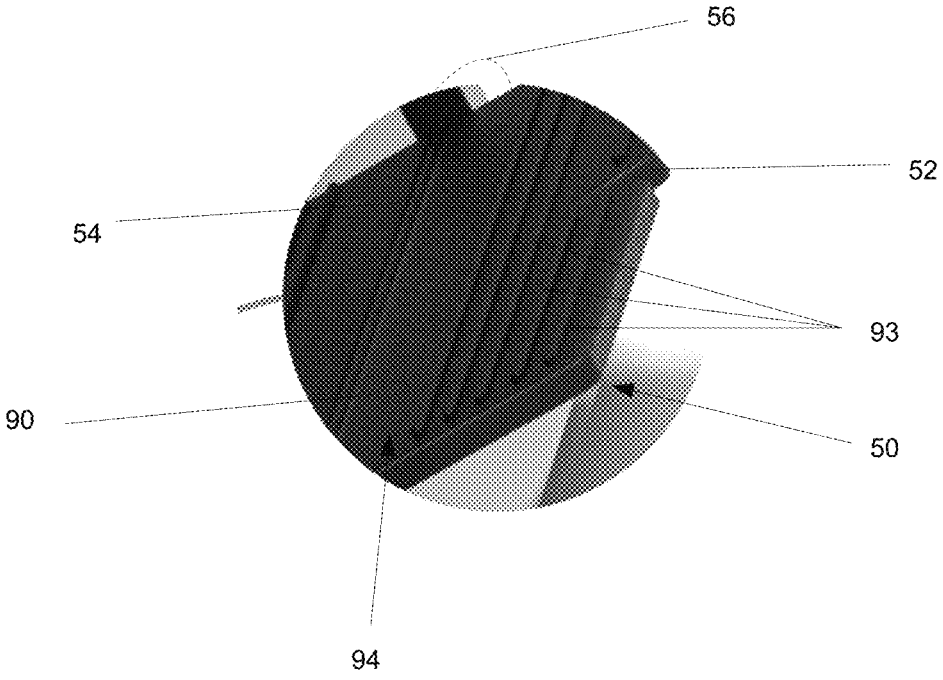
FIG. 6 is another enlarged perspective view of a shelf of a portable table top display in accordance with the principles of the invention.

As seen in FIGS. 5 and 6 the shelf 50 has a grooved slot 88 around the outer edge 94 of the front surface of the shelf 92. A mat 90 may be inserted into the grooved slot 88 and rest on the front surface of the shelf 92. The mat 90 may be comprised of rubber, neoprene, or other non-slip material. Additionally, the mat 90 may have one or more longitudinal ridges 93 on the top surface 94. Optionally, the shelves have a rubber coating or other non-slip surface.

Figure 7:
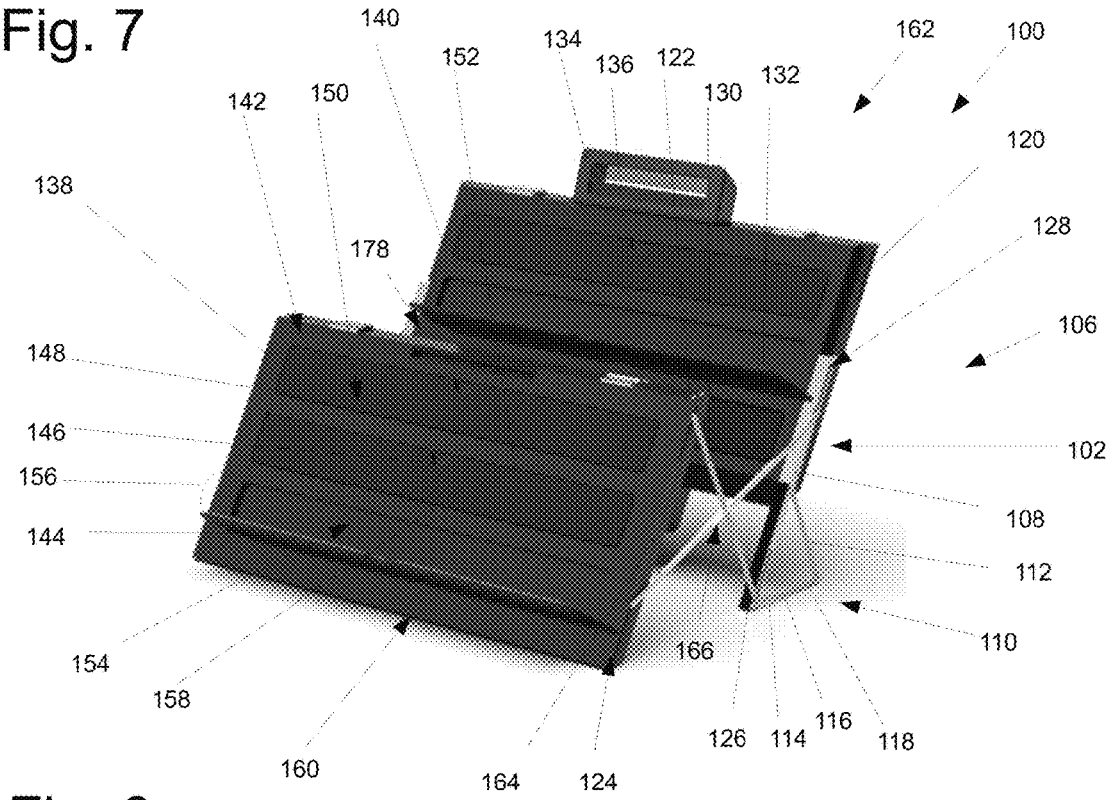
FIG. 7 is a perspective view of an alternative embodiment of a portable table top display in the extended configuration in accordance with the principles of the invention.
Figure 8:
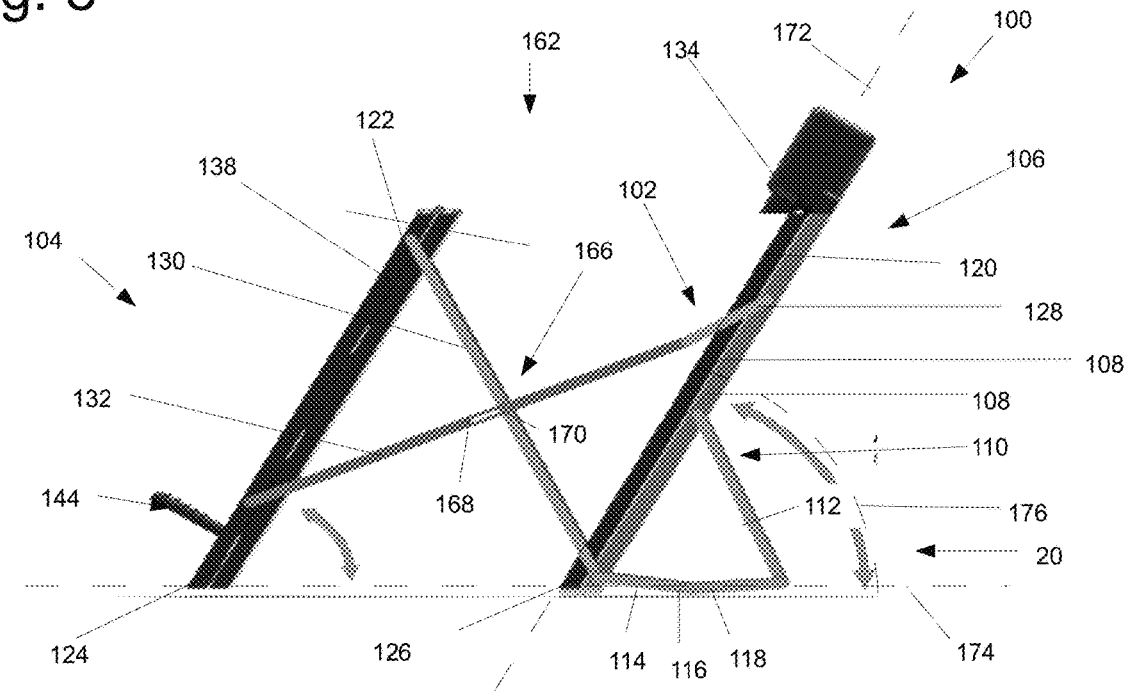
FIG. 8 is a side view of a portable table top display in the extended configuration in accordance with the principles of the invention.

FIGS. 7 and 8 show a portable table top display 100 in the extended configuration 162, in accordance with the principles of the invention. The portable table top display 100 has an articulated frame 102 composed of two opposing vertical members 108. The rear panel 106 of the display 100 extends between the frame 102 and contains a mounting system attached to the back side of the frame. In this embodiment, the rear panel 106 is substantially rectangular. As shown herein, the mounting system is a retractable kickstand 110. The kickstand 110 has two supporting members 112 of equal length attached to the frame 102. Furthermore, the kickstand 110 has a first arm 114 and a second arm 118 of equal length, wherein a back end of the first arm and front end of the second arm are connected to each other by a hinge 116 and the front end of the first arm 114 is connected to the bottom side of the opposing vertical member 126, and the back end of the second arm 118 is connected to the bottom of the supporting member 112. As shown in the embodiment, when the display is in the extended configuration 162, the first arm 114 and second arm 118 extend consecutively.

As shown herein, the portable table top art 100 display has two congruent panels—a rear panel 106 and a front panel 104. However, those having ordinary skill in the art will appreciate that the portable table top display 100 may consist of three or more panels attached in a similar fashion. The front panel 104 has two opposing peripheral sides 122, and two opposing scissor legs 130 and 132 connect the front panel 104 to the frame 102. The first scissor leg 130 extends diagonally from the ridge on the upper peripheral side 122 of the front panel 104 to the ridge on the bottom side of the opposing vertical member 128. The second scissor leg 132 extends diagonally from the ridge on the lower peripheral side of the front panel 124 to the ridge on the top side of the opposing vertical member 128. The scissor legs 130 and 132 contain a pin hinge system. The first scissor leg 130 contains a pin 170 in the center, and the second scissor leg 132 contains a slot 168 in the center. When the front panel 104 is pulled away from the rear panel 106 to fully translate the panels into the extended configuration 162, the second scissor leg 132 slides up the ridge on the lower peripheral side 124 of the front panel and down the ridge on the top side of the opposing vertical member 128. The pin 170 on the first scissor leg 130 slides along the slot 168 on the second scissor leg 132, which keeps the legs 130 and 132 from separating, and guides the front panel 104 as it is extended. The rear panel 106 also has a handle 134 that extends from the upper side of the rear panel 106 and houses a locking mechanism 136. In this embodiment, in the extended configuration 162, the front panel 104 and the rear panel 106 rest at an angle of configuration 176 with the horizontal 174 of sixty degrees. Those having ordinary skill in the art will appreciate that the front panel 104 and the rear panel 106 may tilt 172 less with the horizontal 174 causing the angle of inclination 176 to be greater than sixty degrees, or more with the horizontal 174 causing the angle of inclination 176 to be less than sixty degrees.

The front side of the front panel 138 and the front side of the back panel 140 each contain at least one recess 154. Each recess 154 contains a shelf 144 complementary to the recess 154 on the front side of the front side of the front panel 138 and the front side of the back panel 140 such that the bottom side of the shelf 158 is flush with the front side of the front panel 138 and the front side of the back panel 140 in the folded position 142. As shown herein, the front side of the front panel 138 and the front side of the back panel 140 contain three shelves 144 each. However, those having ordinary skill in the art will appreciate that the front side of the front panel 138 and the front side of the back panel 140 may house as few as one or two shelves, or four or more shelves. Each shelf 144 contains a hinge 148 on a bottom edge 150 and a finger slot 146 on the top edge 152. The finger slot 146 may be used to translate the shelf 144 around the hinge 148 from the folded position 142 to the open position 160. As shown herein, the angle of translation 156 is ninety degrees. However, the shelf 144 may optionally translate more or less than ninety degrees.

Figure 9:
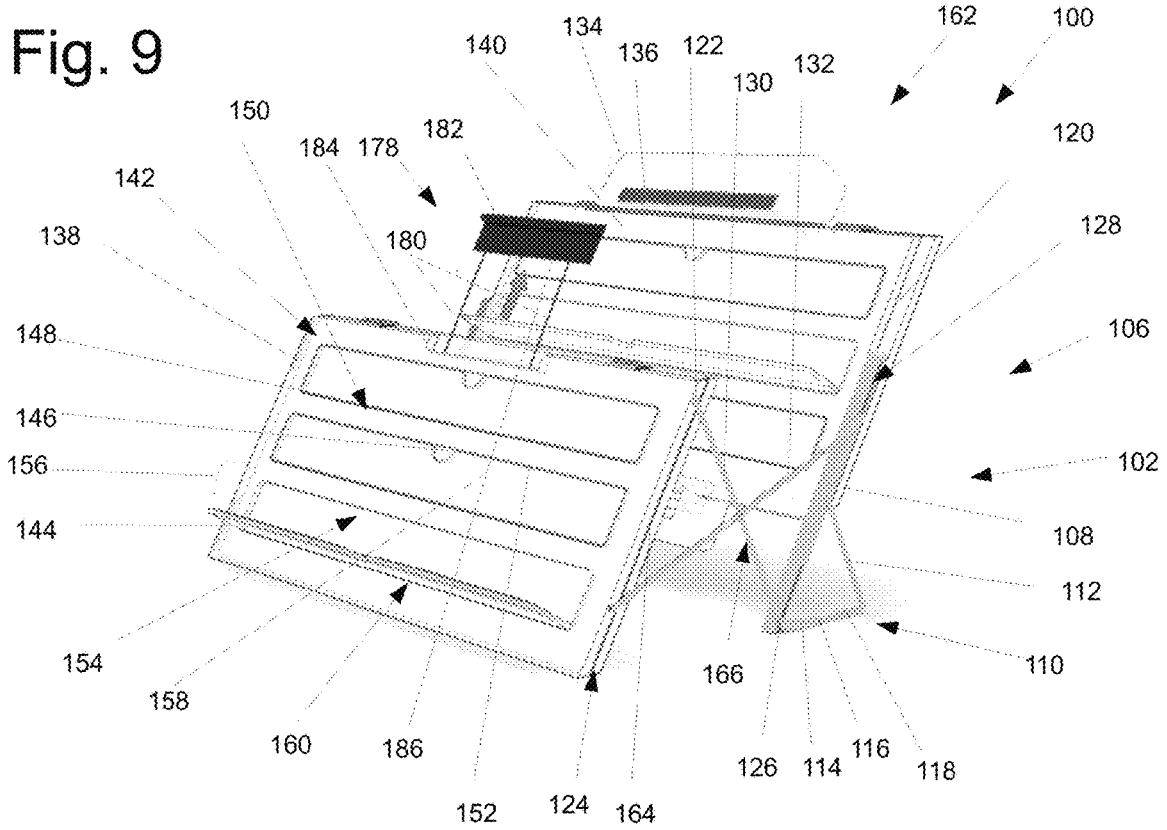
FIG. 9 is a perspective view of a portable table top display in the extended configuration in accordance with the principles of the invention.
Figure 10:
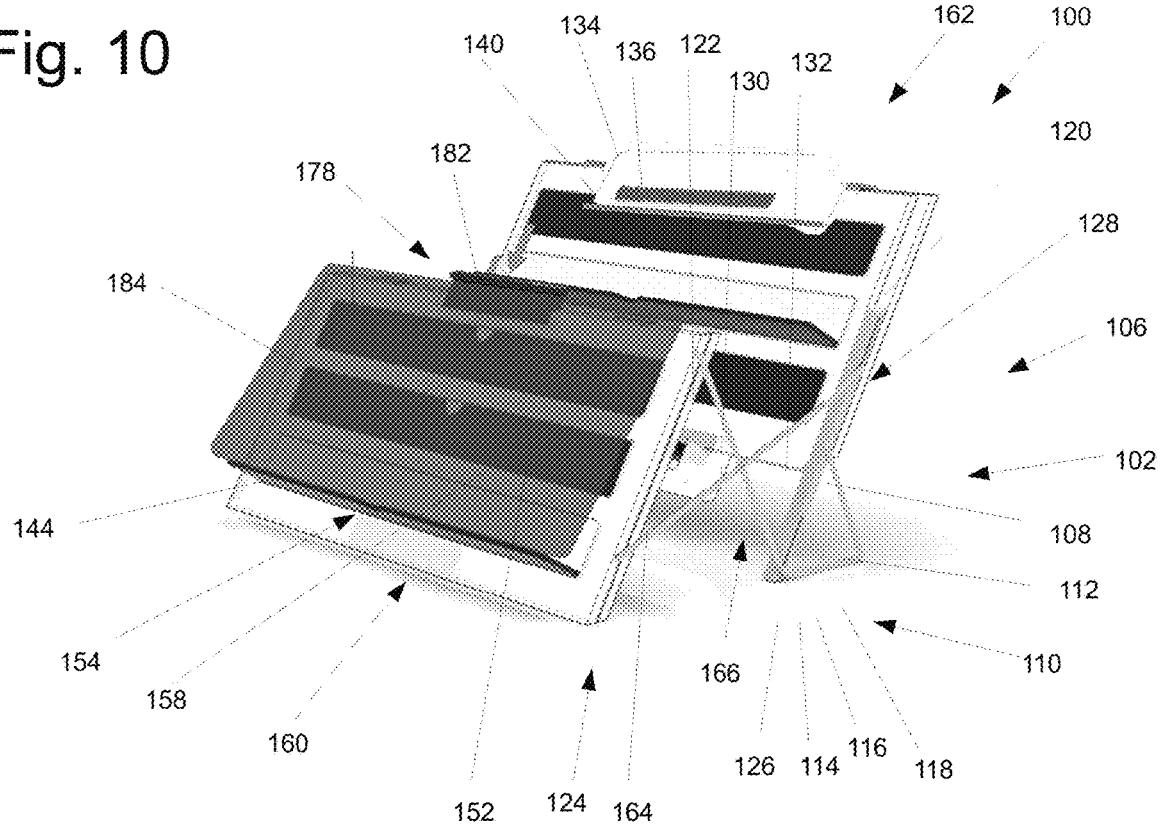
FIG. 10 is a perspective view of a portable table top display in the extended configuration in accordance with the principles of the invention.
Figure 11:
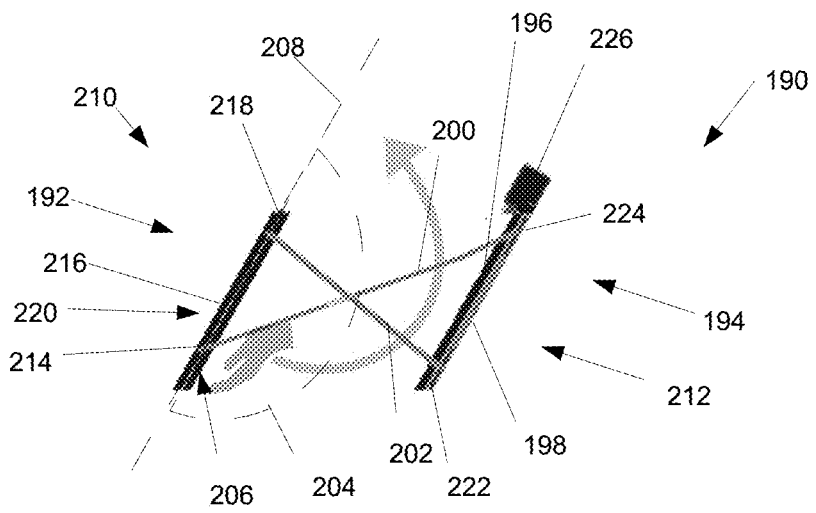
FIG. 11 is a side view of an alternative embodiment of a portable table top display in the extended configuration in accordance with the principles of the invention.
Figure 12:
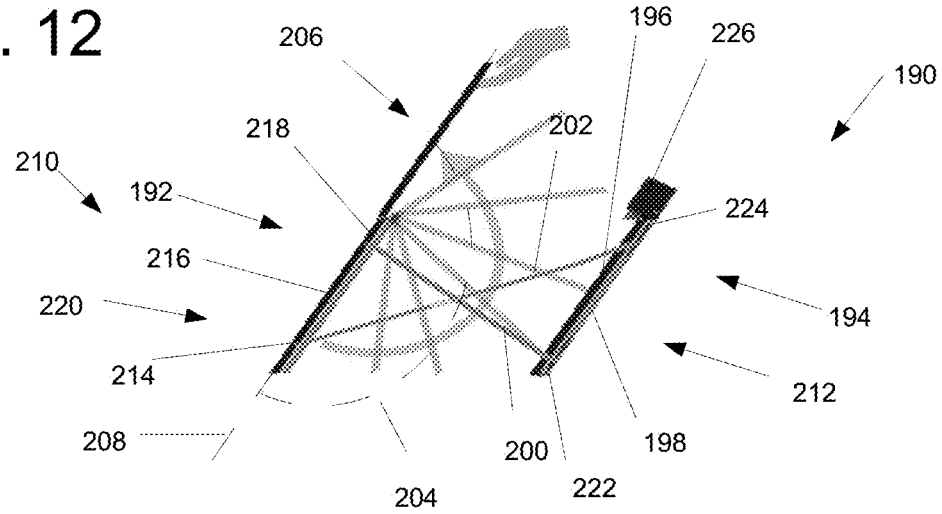
FIG. 12 is a side view of a portable table top display translating the first back board of the front panel from the inactive position to the active position in accordance with the principles of the invention.
Figure 13:
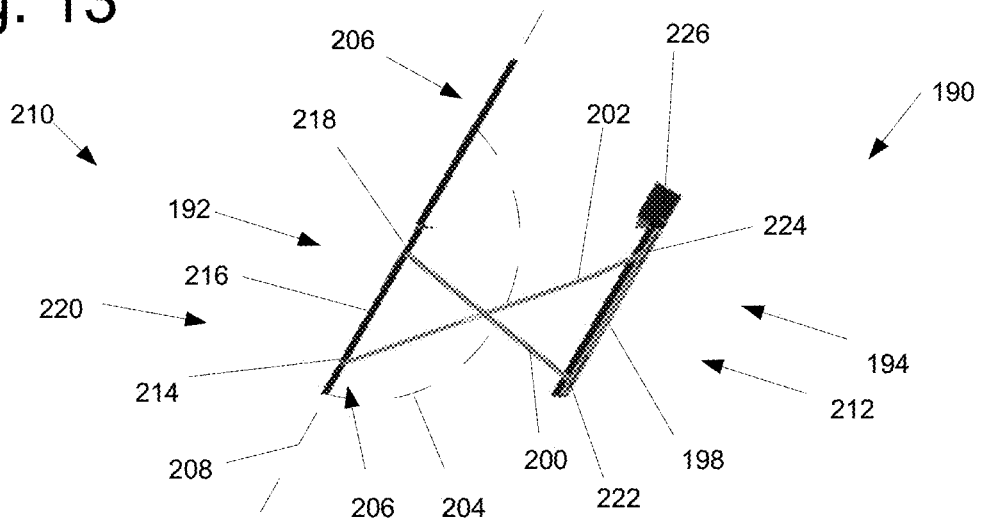
FIG. 13 is a side view of a portable table top display with the first back board of the front panel in the active position in accordance with the principles of the invention.
Figure 14:
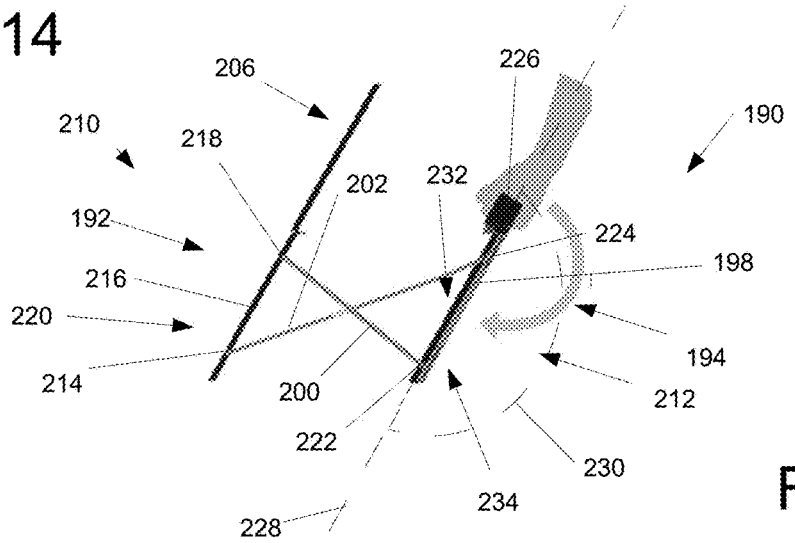
FIG. 14 is a side view of a portable table top display rotating the rear panel around the frame in accordance with the principles of the invention.

FIGS. 9 and 10 display perspective views of the same embodiment as in FIGS. 7 and 8 of a portable table top display 100 in the extended configuration 162, in accordance with the principles of the invention. As shown, the front panel 104 contains a recessed slot 154 that houses an art lock 178. The art lock 178 has a back support 186, an upper diagonal lip 182 attached to the top of the back support 186, and two telescopic pointers 180 with a friction lock system on the bottom of the back support 186. In use, the art lock 178 is pulled up, and the lightweight artwork 184 is placed on the shelf 144. The lightweight artwork 184 rests against the back support 186. To secure in place, the art lock 178 is pushed back down, and the lightweight artwork 184 held in place by the upper diagonal clamp 182.

FIGS. 11-18 display side views of an alternative embodiment of a portable table top display 190 in the extended configuration 210, in accordance with the principles of the invention. In this embodiment, the portable table top display 190 has an articulated frame 212 composed of two opposing vertical members 198, and a rear panel 194 that extends between the frame 212. As shown herein, the portable table top display 190 display has two congruent panels—a rear panel 194 and a front panel 192. The front panel 192 has two opposing peripheral sides 216, and two opposing scissor legs 200 and 202 connect the front panel 192 to the frame 212. The first scissor leg 200 extends diagonally from the upper peripheral side 218 of the front panel 192 to the bottom side of the opposing vertical members 222. The second scissor leg 202 extends diagonally from the lower peripheral side of the front panel 214 to the top side of the opposing vertical member 224. The rear panel 194 also has a handle 226 extending from the upper side of the rear panel 194.

The front panel 192 has a first front board 220 and a first back board 206. In the inactive position the first back board 206 lies flush against the back of the first front board 220 and the first back board 206 and first front board 220 are concurrent. This is demonstrated in FIG. 11. As shown in the following figure, FIG. 12, the first back board 206 is translated from the inactive position to the active position. This is done by rotating the first back board 206 about an angle 204 of one hundred eighty degrees, relative to the plane of the front panel 208. In the active position, the first back board 206 and first front board 220 are consecutive and lie in the same plane 208. This orientation is demonstrated in FIG. 13.

Figure 15:
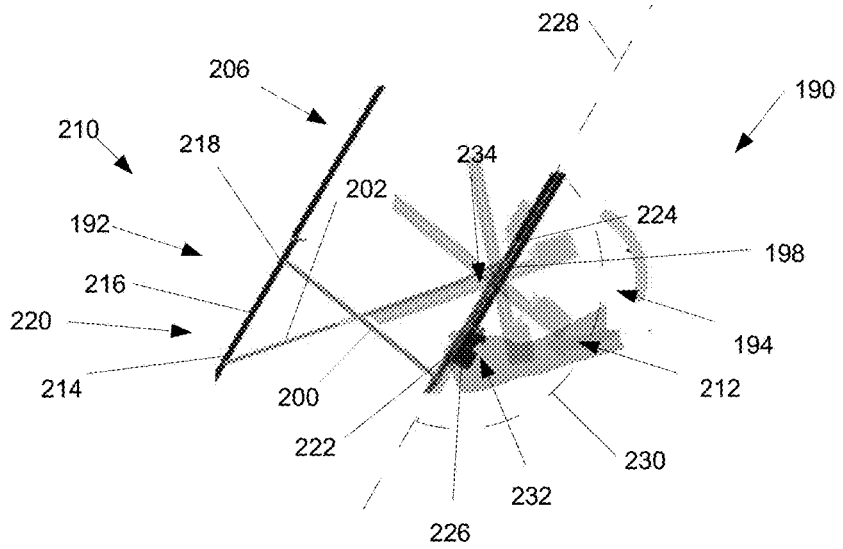
FIG. 15 is a side view of a portable table top display translating the rear back board of the rear panel from the inactive position to the active position in accordance with the principles of the invention.
Figure 16:
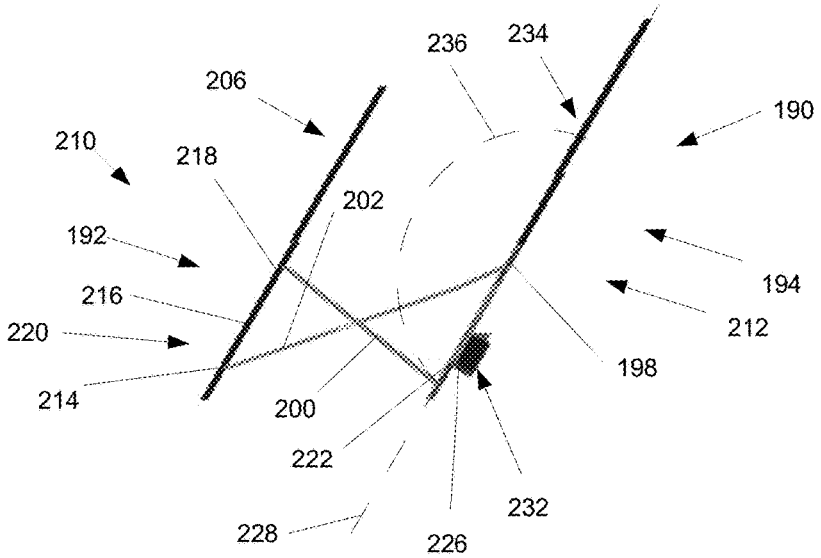
FIG. 16 is a side view of a portable table top display with the rear back board of the rear panel in the active position in accordance with the principles of the invention.

The rear panel 194 has a rear front board 232 and a rear back board 234. In the inactive position the back of the rear front board 232 lies flush against the front of the rear back board 234 and the rear front board 232 and rear front board 234 are concurrent. This is demonstrated in FIG. 14. As shown in the following figure, FIG. 15, to expand the rear panel 194, the rear panel 194 is first rotated around the frame 212 by an angle 230 of one hundred eighty degrees, relative to the plane of the rear panel 228. As shown in FIG. 15, in this position, the rear panel 194 is fully rotated and the handle 226 on the rear panel 194 is now shown to be at the bottom of the display 190. From this inverted position, the rear back board 234 on the rear panel 194 can now be translated from the inactive position to the active position. This is done by rotating the rear back board 234 about an angle 236 of one hundred eighty degrees, relative to the plane of the rear panel 228. In the active position, the rear back board 234 and rear front board 232 are consecutive and lie in the same plane 228. This orientation is demonstrated in FIG. 16.

Figure 17:
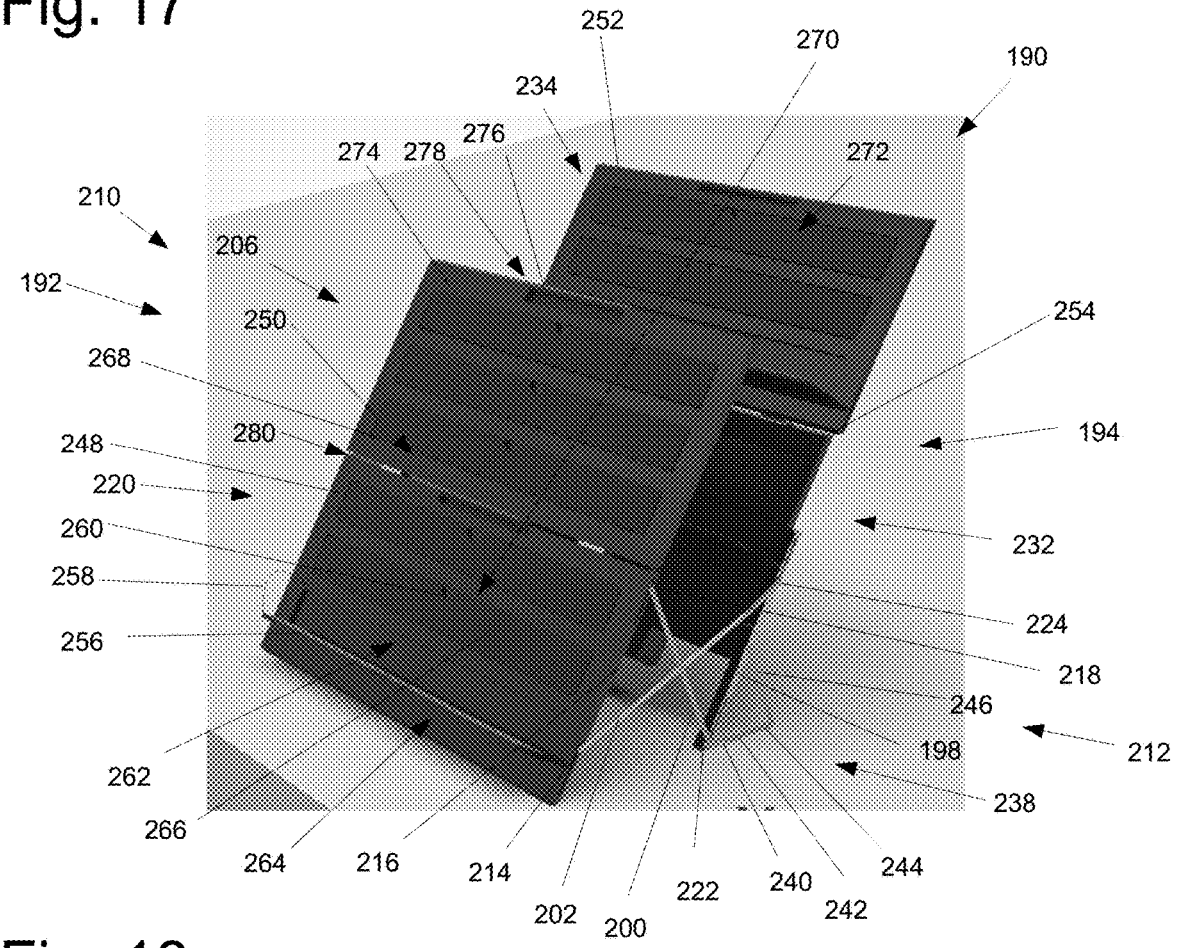
FIG. 17 is a perspective view of a portable table top display with both the first back board of the front panel and the rear back board of the rear panel in the active positions in accordance with the principles of the invention.

FIG. 17 displays a perspective view of the portable table top display 190 with both the first back board 206 of the front panel 192 and the rear back board 234 of the rear panel 194 in the active positions in accordance with the principles of the invention. As shown herein, the mounting system is a retractable kickstand 238. The kickstand 238 has two supporting members 246 of equal length attached to the frame 212. Furthermore, the kickstand 238 has a first arm 240 and a second arm 244 of equal length, wherein a back end of the first arm and front end of the second arm are connected to each other by a hinge 242 and the front end of the first arm 240 is connected to the bottom side of the opposing vertical member 222, and the back end of the second arm 244 is connected to the opposite end of the supporting member 246. Furthermore, the front side of the first front board 248, the front side of the first back board 274, the front side of the rear back board 252, and the front side of the rear front board 254 each contain at least one recess 262. Each recess 262 contains a shelf 256 complementary to the recess 262 such that the bottom side of the shelf 266 is flush with the front side of each of the boards in the folded position 272. As shown herein, the front sides of the boards 248, 274, 252, and 254 contain three shelves 256 each. However, those having ordinary skill in the art will appreciate that the front side of the boards 248, 274, 252, and 254 may house as little as one or two shelves, or four or more shelves. Each shelf 256 contains a hinge 268 on a bottom edge 250 and a finger slot 260 on the top edge 270. The finger slot 260 may be used to translate the shelf 256 around the hinge 268 from the folded position 272 to the open position 264. As shown herein, the angle of translation 258 is ninety degrees. Finally, each board 248, 274, 252, and 254 contains an art lock 278 with an upper diagonal lip 276 at the top of the lock 278.

Figure 18:
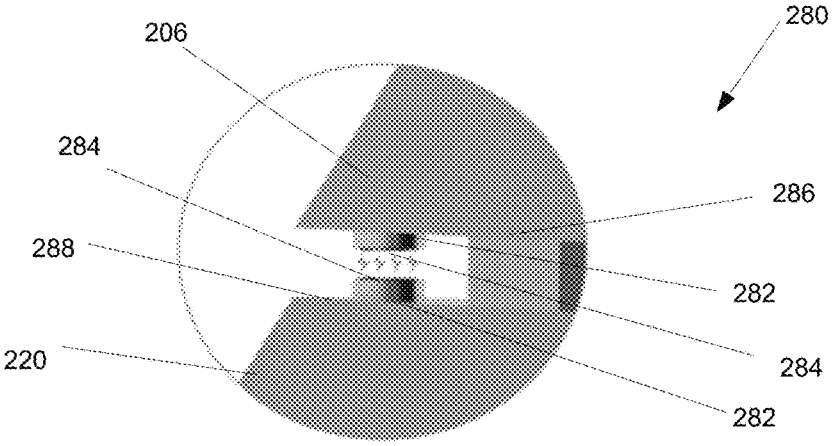
FIG. 18 is an enlarged perspective view of the magnetic locking mechanism that holds both the first back board of the front panel and the rear back board of the rear panel in the active position in accordance with the principles of the invention.

FIG. 18 is an enlarged perspective view of the locking mechanism 280 that holds both the first back board 206 of the front panel 192 and the rear back board 234 of the rear panel 194 in the expanded position in accordance with the principles of the invention. As shown herein, the locking mechanism 280 is a neodymium magnet 282 installed on the bottom side 286 of the first back board 206 and installed on the top side 288 of the first front board 220. In use, when the top surface of the magnet 284 on the bottom side 286 of the first back board 206 and on the top side 288 of the first front board 220 come into contact, the opposing magnetic forces draw the first back board 206 to the first front board 220, locking it into place. Though neodymium magnets are used herein, those having ordinary skill in the art will appreciate that any fastening device may be used to secure the panels in the active position, such as, a hoop and loop fastener, a snap fit lock, a reusable adhesive on the surfaces of the panels, or the like.

Figure 19:
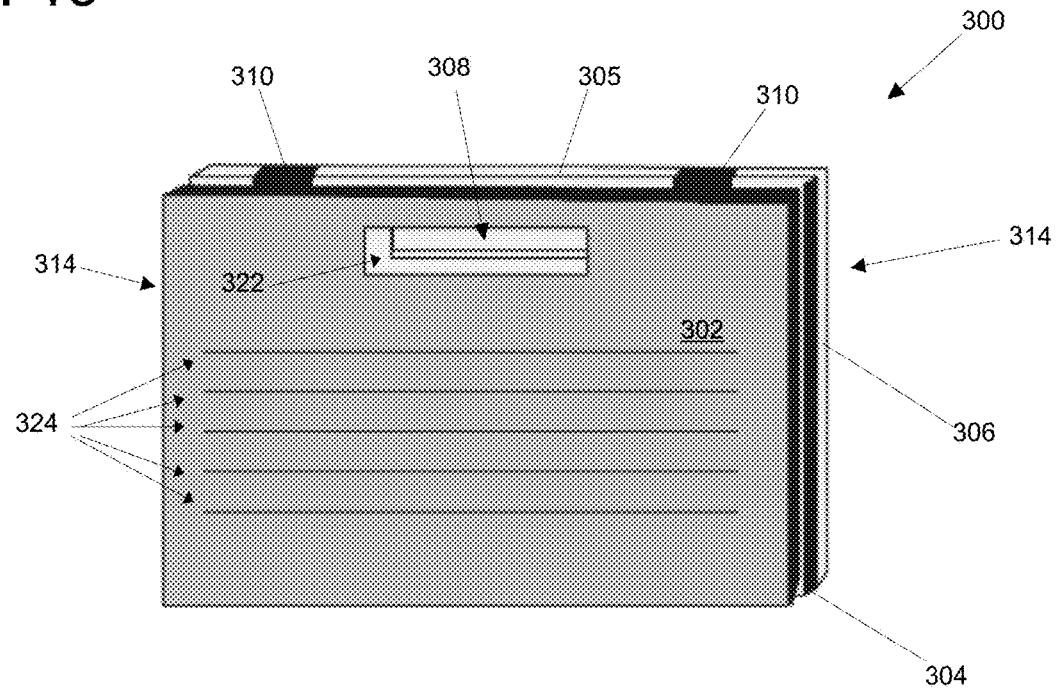
FIG. 19 is a front perspective view of alternative embodiment of a portable table top display in a collapsed configuration in accordance with the principles of the invention.

FIGS. 19-27 show an alternative embodiment of a tabletop display 300 in accordance with principles of the invention, having three panels, alternative articulated frames and removable shelves. FIG. 19 shows the tabletop display 300 in a fully collapsed configuration in which the front panel 302, a center, or middle, panel 304, and rear panel 306 lie flush against one another. In this embodiment, the three panels 302, 304 and 306 are congruent. Optionally, all three panels may have different dimensions and/or shapes. Each of the panels has a plurality of slots 324 for removably attaching shelves as shown below. The front panel 302 includes a front aperture 322 which aligns with apertures in the other panels to form a handle opening 308 which allows the display 300 to be held by a single hand for easy portability. Hinges 310 located at the top 303 of the middle panel 304 rotatably connect it to the bottom 305 of the rear panel 306.

Figure 20:
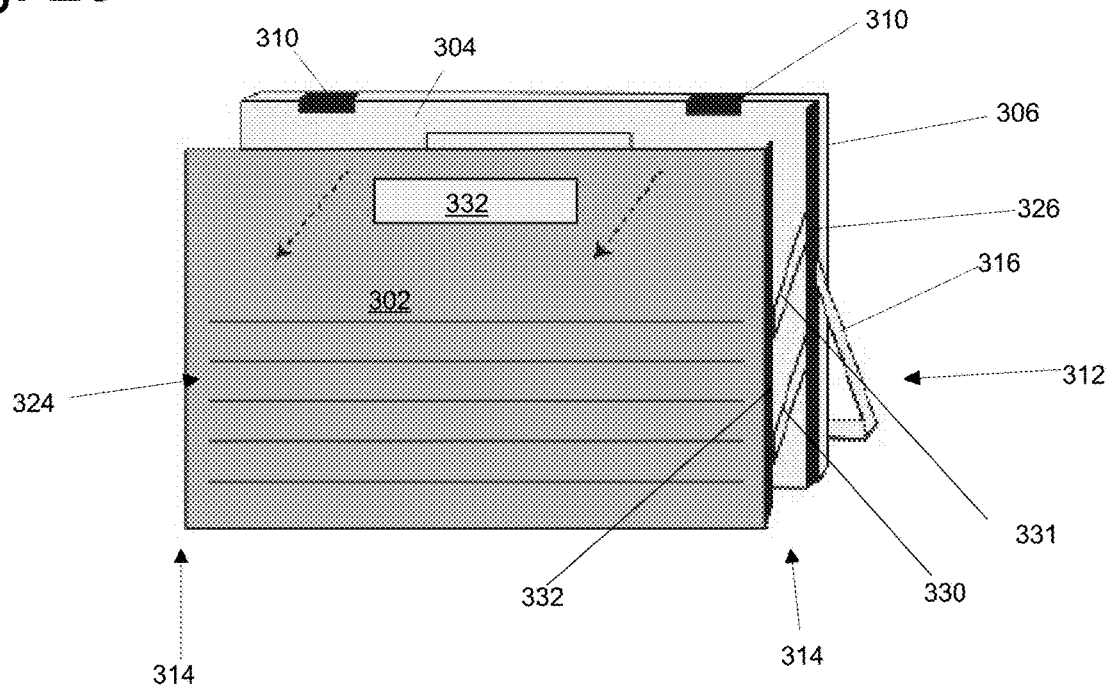
FIG. 20 is a front perspective view of an alternative embodiment of a portable table top display in a partially extended configuration accordance with the principles of the invention.
Figure 21:
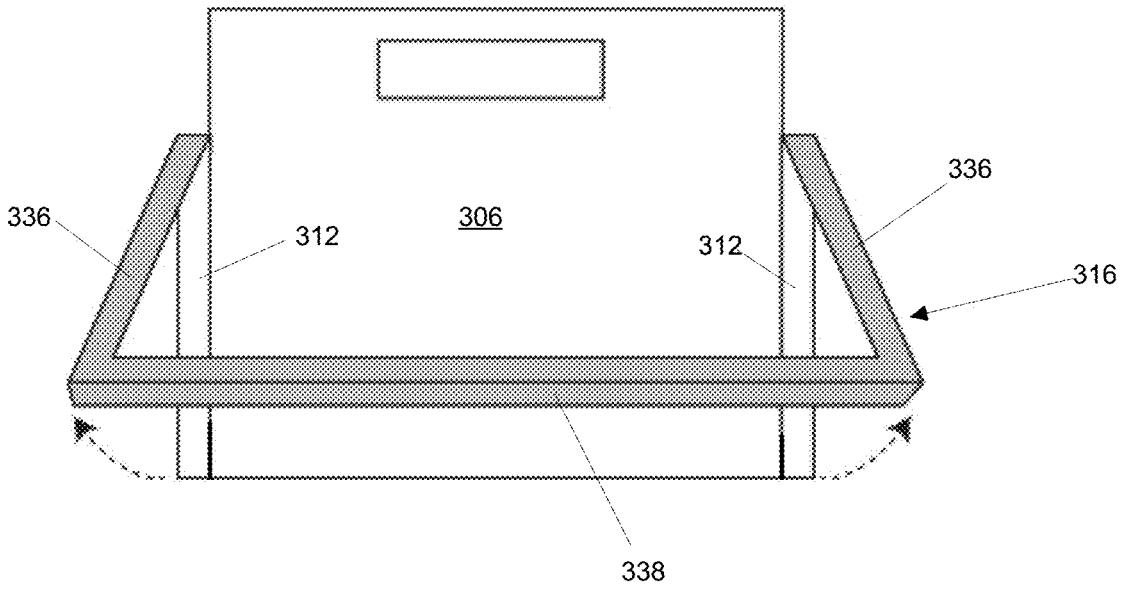
FIG. 21 is a rear perspective view of an alternative embodiment of a portable table top display in accordance with the principles of the invention.

FIG. 20 shows the tabletop display 300 in which the articulated frames 312, located on each lateral side 314 of the display 300, have been translated into the partially extended position. The two opposing frames could be identified as a first lateral frame and a second lateral frame, but are generally referred to herein as the lateral frames 312. The frames are opposing, i.e. they are mirror images of each other, as the entire display is bilaterally symmetric. In the articulated frame's extended position, the kickstand 316 is rotated backwards to support the display in an inclined orientation, and the front panel 302 is separated from the middle panel 304. The kickstand 316 is rotatably attached to a central strut 326 of the articulated frame 312. Also shown are the two braces 330 and 331 which connect the front strut 332 to the central strut 326 and are rotated to expand the display 300, shown in FIG. 20. As with the earlier embodiments, tabletop display 300 includes two opposing articulated frames 312, one on each of its lateral sides 314. FIG. 21 shows the kickstand 316 which rotates away from the articulated frames 312 rearward behind rear panel 306 when translating the display 300 into the extended configuration. The kickstand 316 includes two side arms 336 and a base 338.

Figure 22:
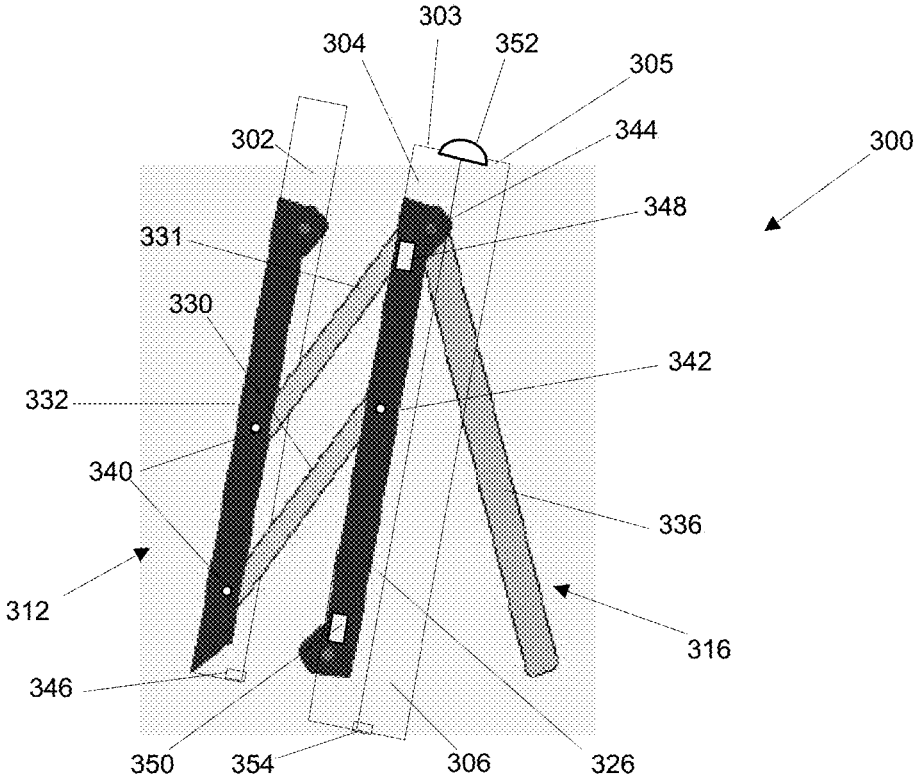
FIG. 22 is a side elevation view of an articulated frame of an alternative embodiment of a portable table top display in accordance with the principles of the invention.

FIG. 22 shows one of the two opposing articulated frames 312 when the tabletop display 300 is in a first stage of conversion into the extended configuration. The lock 346 at the bottom of the front panel 302 is disengaged to separate the front panel from the middle panel 304. In this embodiment, the locks 346 and 354 are at the bottoms of the panels. Optionally, the locks may be located in any region of the panels, or may optionally be incorporated into the articulated frames themselves. Optionally, a lock may be located at both the tops and bottoms of the front and middle panels. The front and middle panels 302 and 304 are pulled apart by rotating the upper brace 331 and the lower brace 330. The kickstand 316 may optionally be extended the beginning, the end, or another time point in the process of translating from the collapsed to the extended position. The front strut 332 is attached to the lateral side of the front panel 302. Optionally, the front strut 332 may be formed as an integral part of the front panel 302. The central strut 326 is connected to the front strut 332 by the upper brace 331 and lower brace 330. The braces 330 and 331 are rotatably attached to the front strut 332 by hinge pins 340. The upper brace 331 is rotatably attached to the central strut 326 by a hinge pin 344, which also connects the central strut 326 to the arm of the kickstand 316. Hinge pin 342 connects the lower brace 330 to the central strut 326. Those skilled in the art will appreciate that as the braces 330 and 331 rotate to separate front panel 302 from middle panel 304, the two panels remain parallel to each other. Optionally, the braces 330 and 331 may be of different lengths such that the front and middle panels 302 and 304 are not parallel when they are pulled apart. The braces of this embodiment are configured so that they may rotate no more than about 30° when in the fully extended configuration. Optionally, the frame 312 may be configured to only allow the braces to rotate more or less than 30°. One or more lockable hinges 352 at the top of the middle panel 304 rotatably connect it to the rear panel 306. A lock 354 at the bottom of the rear panel 306 secures the middle and rear panels against each other when in the collapsed configuration.

Figure 23:
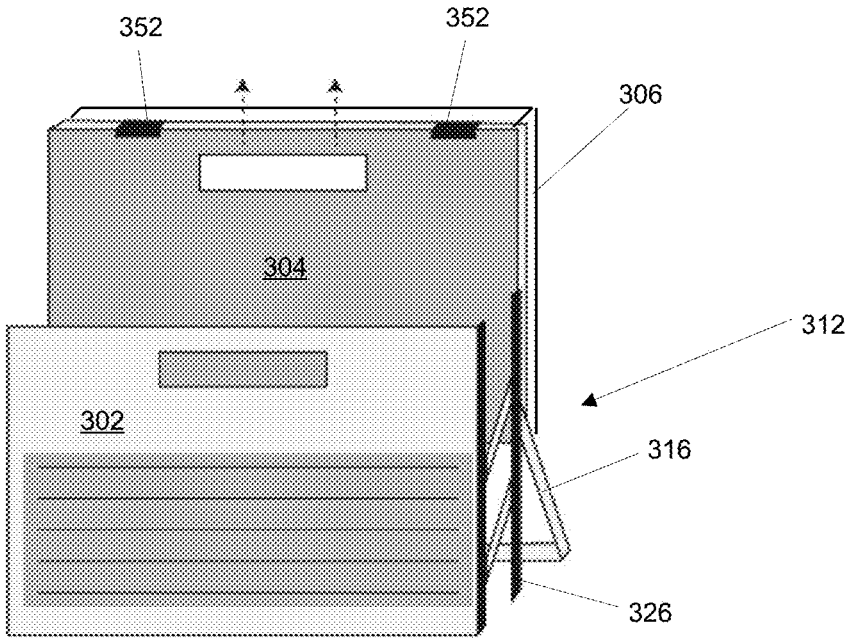
FIG. 23 is a front perspective view of an alternative embodiment of a portable table top display in a partially extended configuration in accordance with the principles of the invention.

The central strut 326 is slidingly engaged to the lateral side of the middle panel 304, and includes an upper slot 348 and a lower slot 350. In the collapsed configuration, a retractable tab 356 (shown in FIG. 25) on the lateral side of the middle panel 304 extends into the lower slot 350. To translate the middle panel 304 into the raised configuration, the tabs are retracted, the middle panel 304 is slid upward along the central strut 326, and the retractable tabs are then inserted into the upper slot 348 to secure the middle panel 304 in the raised position, as shown in FIG. 23.

Figure 24:
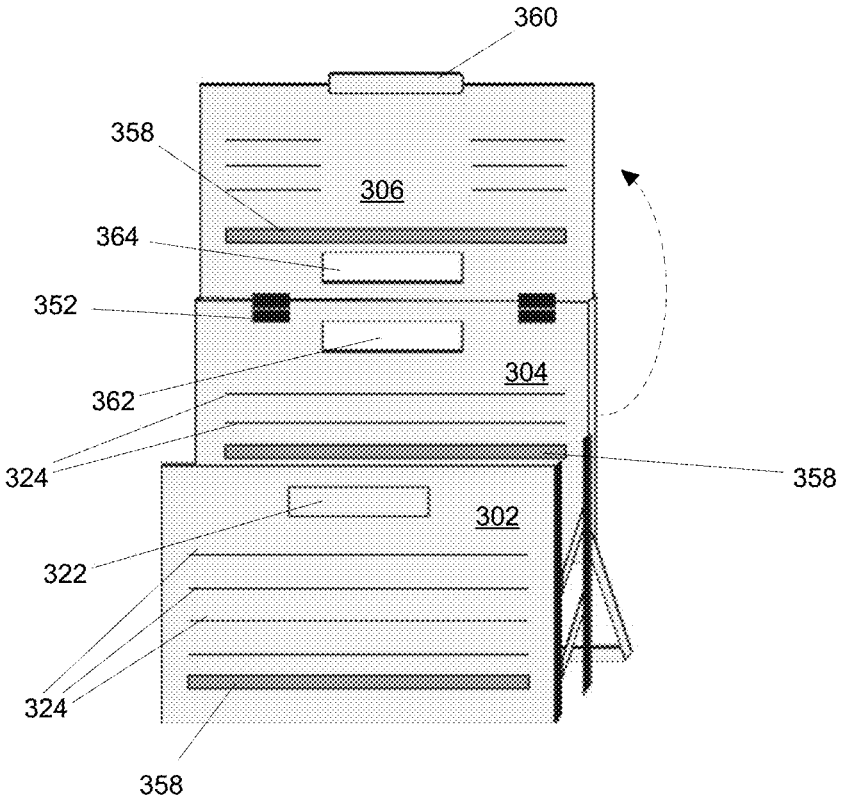
FIG. 24 is a front perspective view of an alternative embodiment of a portable table top display in a fully extended configuration in accordance with the principles of the invention.
Figure 25:
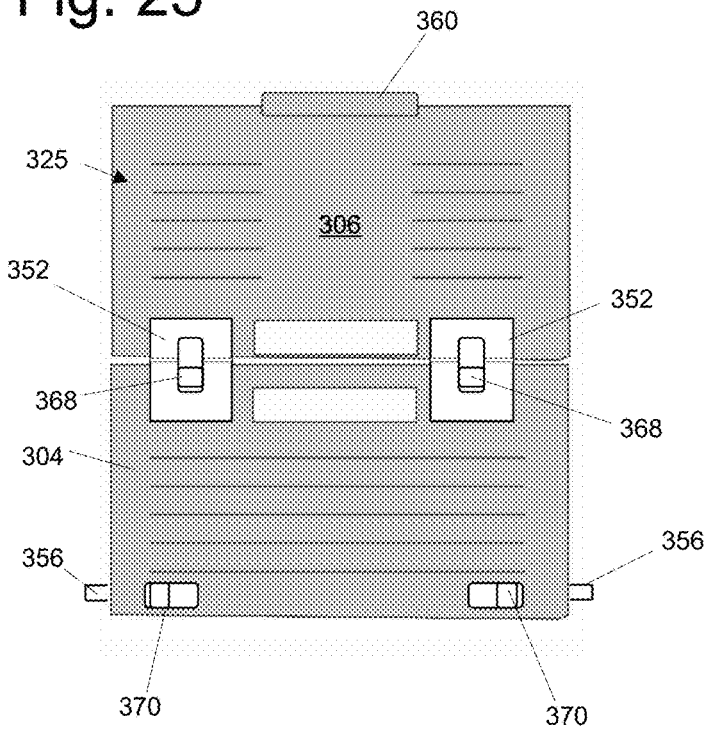
FIG. 25 is a front elevation view of a center panel and a rear panel of an alternative embodiment of a portable table top display in accordance with the principles of the invention.

Referring to FIGS. 24 and 25, the rear panel 306 is rotated 180° about the lockable hinges 352 such that it extends upward from and is substantially coplanar to the middle panel 304. The lockable hinges 352 are then locked to hold the rear panel 306 in the extended configuration, as shown in FIGS. 24 and 25. Shelves 358 are then inserted into one or more of the slots 324 on the front, middle and rear panels. The rear panel 306 includes a clamp 360 which may be used to secure items placed on the tabletop display 300. The apertures 362 and 364 in the middle and rear panels, align with the aperture 322 in the front panel 302 when the tabletop display 300 is in the collapsed configuration. Referring to FIG. 25, the lockable hinges 352 are locked by sliding the buttons 368 upward, and unlocked by sliding the buttons 368 downward. Optionally, other mechanisms may be used for locking and unlocking hinges 352. Retractable tabs 356 are retracted by sliding the buttons 370 toward the center of the middle panel 304. The rear panel 306 of this embodiment has slots 325 that are discontinuous, and do not extend across the middle of the panel.

Figure 26:
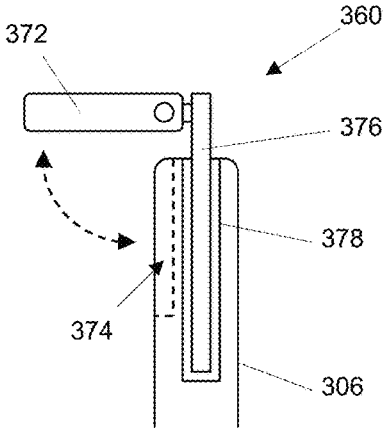
FIG. 26 is a side cutaway view of a clamp of an alternative embodiment of a portable table top display in accordance with the principles of the invention.

FIG. 26 shows the clamp 360 of the tabletop display 300. The clamp 360 includes a brace 372 which may be rotated into a socket 374 when not in use. Brace 372 may be locked into place in the socket 374 when not in use. When used, the clamp 360 extends forward from the rear panel 306 in a direction substantially perpendicular to the rear panel 306. One or more retractable arms 376 are housed within a slot 378 and may be slid up or down so that the brace 372 impinges on the top of one or more objects being displayed. The retractable arms 376 may be locked into place when retracted.

Figure 27:
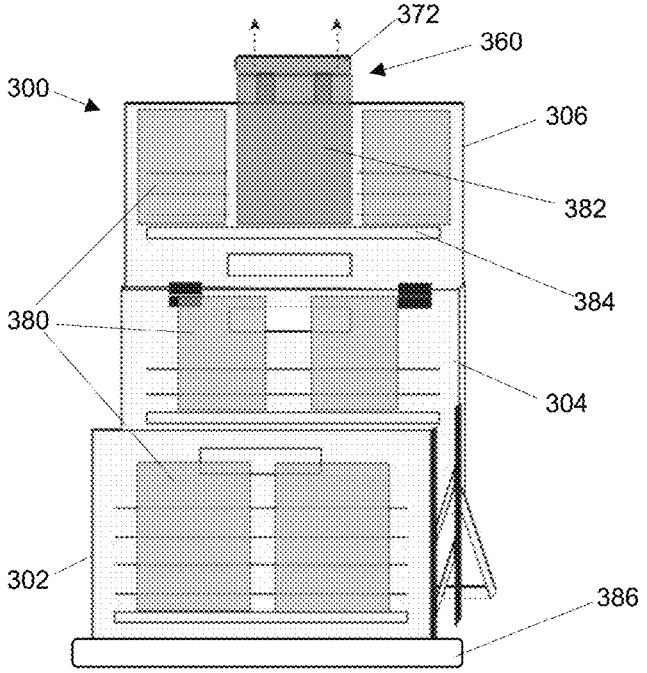
FIG. 27 is a front perspective view of an alternative embodiment of a portable table top display with items placed on its shelves and having a weighted base in accordance with the principles of the invention.
Figure 28:
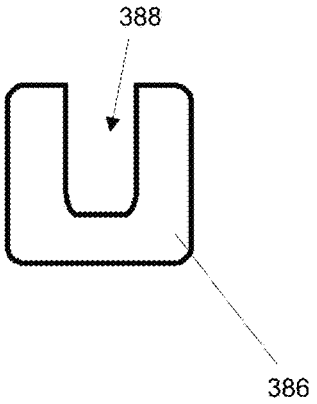
FIG. 28 is a side cutaway view of a weighted base for an alternative embodiment of a portable table top display in accordance with the principles of the invention.

FIG. 27 shows the tabletop display 300 in the fully extended configuration with a plurality of books 380 resting on its shelves. Book 382 is positioned on the shelf 384 affixed to the rear panel 306, with the brace 372 of the clamp 360 securing it in place. FIG. 27 also includes an optional weighted front base 386, also shown in FIG. 28. Because the middle and rear panels 304 and 306 extend upward and backward, placing display items on the shelf 384 may cause the display 300 to fall backwards. To prevent this, the weighted front base 386 may be attached to the bottom of the front panel 302 by inserting the bottom of panel into the slot 388 in the top of the weighted base. Optionally, the weighted base 386 may be an integral part of the panel 302.

Figure 29:
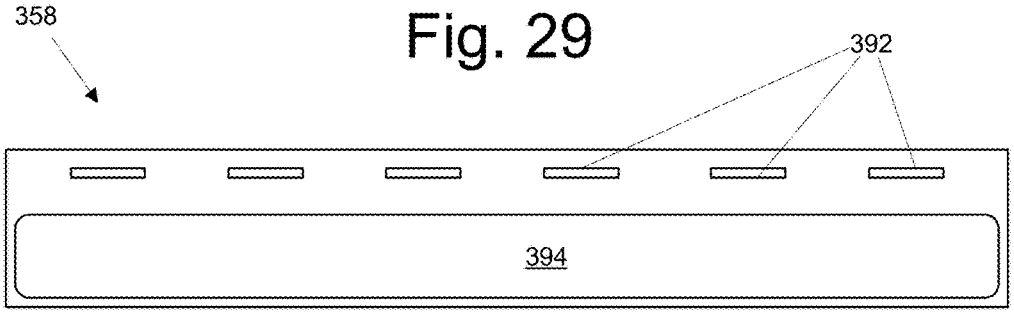
FIG. 29 is a bottom plan view of a weighted shelf for an alternative embodiment of a portable table top display in accordance with the principles of the invention.
Figure 30:
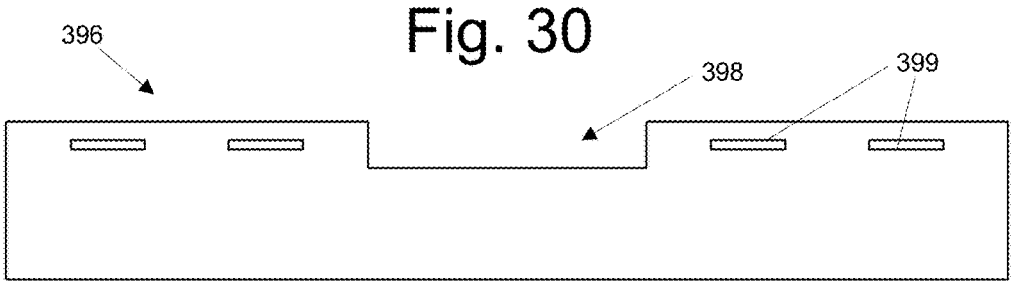
FIG. 30 is a bottom plan view of another shelf for an alternative embodiment of a portable table top display in accordance with the principles of the invention.

FIG. 29 shows a shelf 358 for removable attachment to the slots 324. The shelf 358 includes several protrusions 392 extending down the side of the shelf 358 which is inserted into the slots on a panel. These protrusions 392 allow the shelf 358 to form a friction fit with a slot it has been inserted into. The slot may optionally include one or more indentations complementary to one or more of the protrusions 392. FIG. 29 also includes a weight 394 attached to the bottom of the shelf 358. A shelf having a weight 394 may be placed near the bottom of the front panel 302 to prevent the tabletop display 300 from falling over backward. The weight 394 may optionally be removably attachable to the shelf 358. FIG. 30 shows a shelf 396 having a narrow central region 398 that may be inserted into non-continuous slots 325 shown in FIG. 25, and includes protrusions 399 to create a friction fit with the slot.

Figure 31:
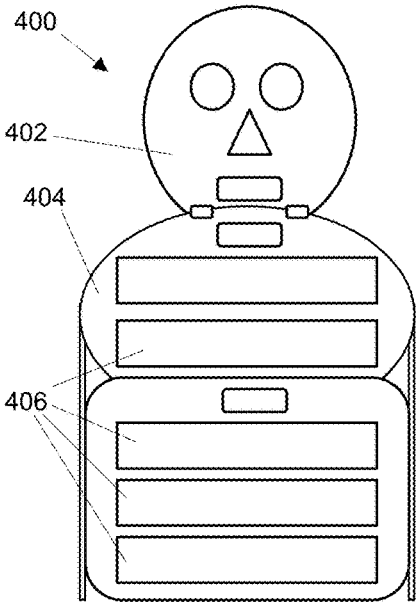
FIG. 31 is a front plan view of another alternative embodiment of a portable table top display in an extended configuration in accordance with the principles of the invention.
Figure 32:
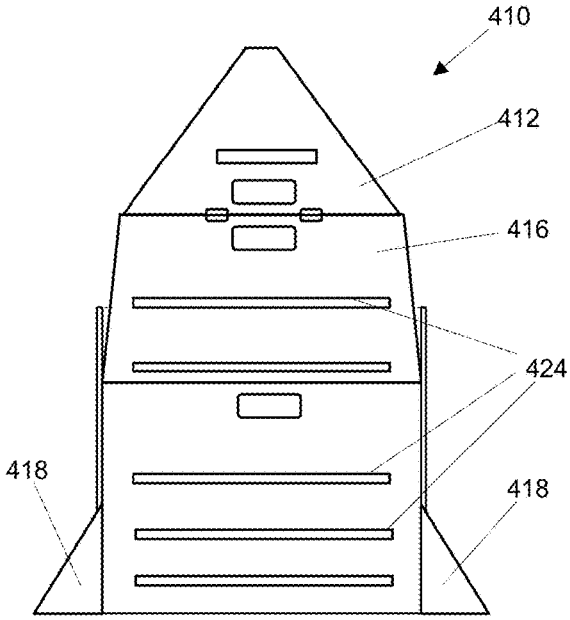
FIG. 32 is a front plan view of another alternative embodiment of a portable table top display in an extended position in accordance with the principles of the invention.

FIG. 31 shows another alternative embodiment of a tabletop display 400. Tabletop display 400 includes an oval rear panel 402 having ornamental features to create the appearance of a face. The middle panel 404 is also oval to give the appearance of a person or a particular character. The display 400 includes a plurality of shelves 406 that may be folded out to support and display books or other materials. FIG. 32 shows another alternative embodiment of a tabletop display 410 having trapezoidal rear and middle panels 412 and 416. Two triangular fins 418 are attached to the bottom of the front panel in order to give the tabletop display 410 the appearance of a rocket ship. Display 410 has a plurality of slots 424 for inserting removably attachable shelves.

Those skilled in the art will appreciate that the various components shown in the various embodiment can be interchanged. For example, the embodiment shown in FIGS. 1-4 could be use the slots and removable shelves of the embodiment shown in FIGS. 19-30, or vice versa. Similarly, the table top display shown in FIGS. 1-4 could include a third rear panel, as shown in FIGS. 19-30, rotatably connected to the panel 16. Unless expressly indicated otherwise, or clearly precluded from the context, any of the various components of the various embodiments may be interchanged.

Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. Descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A portable table top display comprising:

an articulated frame formed by two opposing vertical members;

a rear panel extending between the two opposing vertical members, the rear panel comprising a rear front board and a rear back board, the rear panel being rotatably mounted to the frame such that in an inactive position the rear front board lies flush against the rear back board, and in an active position, the rear panel is rotated approximately 180 degrees about the frame and the rear back board is further rotated approximately 180 degrees to lie consecutive to the rear front board in the same plane;

a retractable kickstand extendable from a back side of the frame;

a front panel congruent with the rear panel and having two opposing peripheral sides, the front panel comprising a first front board and a first back board, the first back board being rotatably mounted to the first front board such that in an inactive position the first back board lies flush against the first front board, and in an active position, the first back board is rotated approximately 180 degrees relative to the plane of the front panel to lie consecutive to the first front board in the same plane;

two opposing scissor legs, each connecting one of the opposing peripheral sides of the front panel to one of the opposing vertical members of the frame; and, a handle extending from an upper side of the rear panel and housing a locking mechanism for securing the front panel and the rear panel;

wherein the portable table top display translates from a collapsed configuration, in which the front and rear panels lie flush against each other, to an extended configuration, in which the panels are separated, when the locking mechanism is released and the scissor legs are actuated; and, wherein the scissor legs maintain the front and rear panels in a parallel orientation to each other when the portable table top display is in the extended configuration.

2. The portable table top display of claim 1 wherein a handle is attached to an upper edge of the rear panel in the inactive position and located at the bottom when rotated 180 degrees into the active position.

3. The portable table top display of claim 2 wherein the first front board, the first back board, the rear front board and the rear back board include a plurality of horizontal slts or removably attaching shelves.

4. The portable table top display of claim 3 wherein the kickstand comprises two supporting members, a first arm, and a second arm, the first and second arms being connected by a hinge and mounted to the articulated frame and supporting members such that the kickstand is retractable.

* * * * *